United States Patent [19]

Yoshino

[11] Patent Number: 4,831,553

[45] Date of Patent: May 16, 1989

[54] PLATE MAKING AND PRINTING PRESS

[75] Inventor: Yukihiko Yoshino, Miyagi, Japan

[73] Assignee: Ricoh Co., Ltd., Tokyo, Japan

[21] Appl. No.: 91,876

[22] Filed: Sep. 1, 1987

[30] Foreign Application Priority Data

Sep. 17, 1986 [JP] Japan ..... 61-143083

[51] Int. Cl.[4] ..... G03G 15/00

[52] U.S. Cl. ..... 364/518; 364/523; 364/525; 355/323; 101/2

[58] Field of Search ..... 355/14 R, 14 C; 364/468, 518, 523, 525; 101/114, 118, 128.4, 2

[56] References Cited

U.S. PATENT DOCUMENTS

| | | | |
|---|---|---|---|
| 3,944,360 | 3/1976 | Deetz et al. | 355/14 |
| 4,275,958 | 6/1981 | Tachika et al. | 355/14 R |
| 4,628,813 | 12/1986 | Hasegawa et al. | 101/116 |

FOREIGN PATENT DOCUMENTS

| | | |
|---|---|---|
| 0036304 | 9/1981 | European Pat. Off. . |
| 1381268 | 1/1975 | United Kingdom . |
| 1466942 | 3/1977 | United Kingdom . |
| 2000727 | 1/1979 | United Kingdom . |
| 1588631 | 4/1981 | United Kingdom . |
| 2124978 | 2/1984 | United Kingdom . |

*Primary Examiner*—A. D. Pellinen
*Assistant Examiner*—Jeffrey A. Gaffin
*Attorney, Agent, or Firm*—Oblon, Fischer, Spivak, McClelland & Maier

[57] ABSTRACT

A plate making and printing press apparatus having a press arrangement including a plate making unit, a printing unit and a sorting unit, a memory for storing printing sheet numbers inputted from a printing sheet number inputting unit, and a control circuit for receiving necessary information from a manuscript presence/absence detecting unit and a continuous mode commanding unit and supplying the information to the units of the press arrangement as necessary.

5 Claims, 3 Drawing Sheets

FIG. 5A

| MEMORY ADDRESS | PRINTING SHEET NUMBER |
|---|---|
| 1 | 30 |
| 2 | 35 |
| 3 | 32 |
| 4 | 38 |
| ⋮ | ⋮ |
| n | 36 |
| n+1 | 0 |

FIG. 5B

| MEMORY ADDRESS | PRINTING SHEET NUMBER |
|---|---|
| 1 | 50 |
| 2 | 0 |

PLATE MAKING AND PRINTING PRESS

BACKGROUND OF THE INVENTION

1. Field of the Invention

This invention relates to a plate making and printing press.

2. Description of the Prior Art

In the past, an integrated plate making and printing press has been unavailable which has a printing sheet number storing memory means in order to realize automatic continuous operation for sorting printed paper sheets. Therefore, when printed paper sheets are desired to be sorted with the conventional plate making and printing press, a sorting means such as a tape marker is actuated at the termination of a printing process for a preset printing sheet number and the printing process is stopped until a subsequent printing process is started. If the subsequent printing process is for the same plate and the same printing sheet number, a print start command can merely be issued. Contrarily, if the subsequent printing is for a different printing sheet number (class sorting printing), it is necessary that a renewed printing sheet number be inputted and then the print start command be issued. In an instance wherein when a printing process based on a plate is finished for a preset printing sheet number, a subsequent printing process based on a different plate is performed, a manuscript for the subsequent printing is set at the termination of the preceding printing and a plate making start command is then issued to perform sequential procedures of "plate discharge", "plate making" and "plate feed".

If the printing sheet number needs to be renewed, a renewed printing sheet number is set and thereafter the subsequent printing is started by operating a print start key. In these cases, the user is forced to constantly engage in the press so as to take care of troublesome operations for individual procedures.

Putting aside the integrated plate making and printing press, a press dedicated to printing has hitherto been available which comprises, in combination, a means for storing a plurality of printing sheet numbers and a means for sorting discharged paper sheets. The conventional printing press can only afford to carry out a continuous operation for sorting paper sheets printed in accordance with the same plate into classes of different sets of printing sheet number.

For sorting paper sheets printed in accordance with different plates, it is necessary that at the termination of a printing process based on a plate, sorting be effected using the sorting means, the plate be discharged and another plate precedently prepared by a plate maker be set and a subsequent printing process be started. The above procedures have to be done repetitiously, resulting in troublesome operations.

SUMMARY OF THE INVENTION

Accordingly, the present invention contemplates elimination of the above drawbacks of the conventional plate making and printing press and has for its object to provide a plate making and printing press in which sorting and other operations can be effected through automatic control without resort to operations for individual procedures performed by the operator.

According to the invention, the above object can be accomplished by a plate making and printing press comprising means, controllable by an electronic circuit, for storing a plurality of printing sheet numbers, means for inputting a printing sheet number to the storing means, means for detecting whether a manuscript for plate making is set or not, means for selecting either a procedure in which a printing process proceeds immediately after termination of a plate making process or a procedure in which the printing process is saved temporarily, and means for sorting discharged printed paper sheets. With the plate making and printing press constructed as above, a printing sheet number is inputted by the printing sheet number inputting means to the storing means which can store a plurality of printing sheet numbers, and on the other hand the manuscript setting detecting means detects whether a manuscript is set or not.

When setting of the manuscript is detected, a plate making process proceeds and at the termination of the plate making process, it is decided as to whether a printing process immediately proceeds or is saved temporarily.

Accordingly, many operations conventionally required for the operator can be dispensed with and only setting a manuscript, setting and inputting a printing sheet number and operating the start key are needed, thereby reducing the number of operations and improving operational efficiency.

BRIEF DESCRIPTION OF THE DRAWINGS

In the accompanying drawings :

FIGS. 5A and 5B are diagrams illustrating memory addresses used in different manners.

DESCRIPTION OF THE PREFERRED EMBODIMENT

The invention will now be described by way of example with reference to the accompanying drawings.

Figure 1:
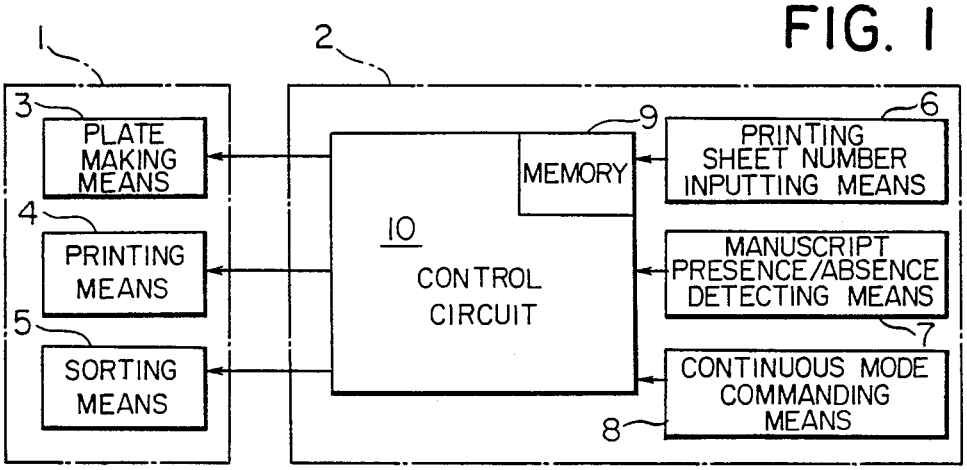
FIG. 1 is a schematic block diagram showing a plate making and printing press according to an embodiment of the invention.

Referring to FIG. 1, a plate making and printing press embodying the invention comprises a press arrangement 1 and a control arrangement 2. The press arrangement 1 includes a plate making means 3, a printing means 4 and a sorting means 5. The control arrangement 2 includes a printing sheet number inputting means 6, a manuscript presence/absence detecting means 7, a continuous mode commanding means 8, a memory 9 to which printing sheet numbers from the printing sheet number inputting means 6 are inputted, and a control circuit 10 operative to receive necessary information from the manuscript presence/absence detecting means 7 and continuous mode commanding means 8 and deliver the information to the means of the press arrangement 1 as necessary.

Figure 4:
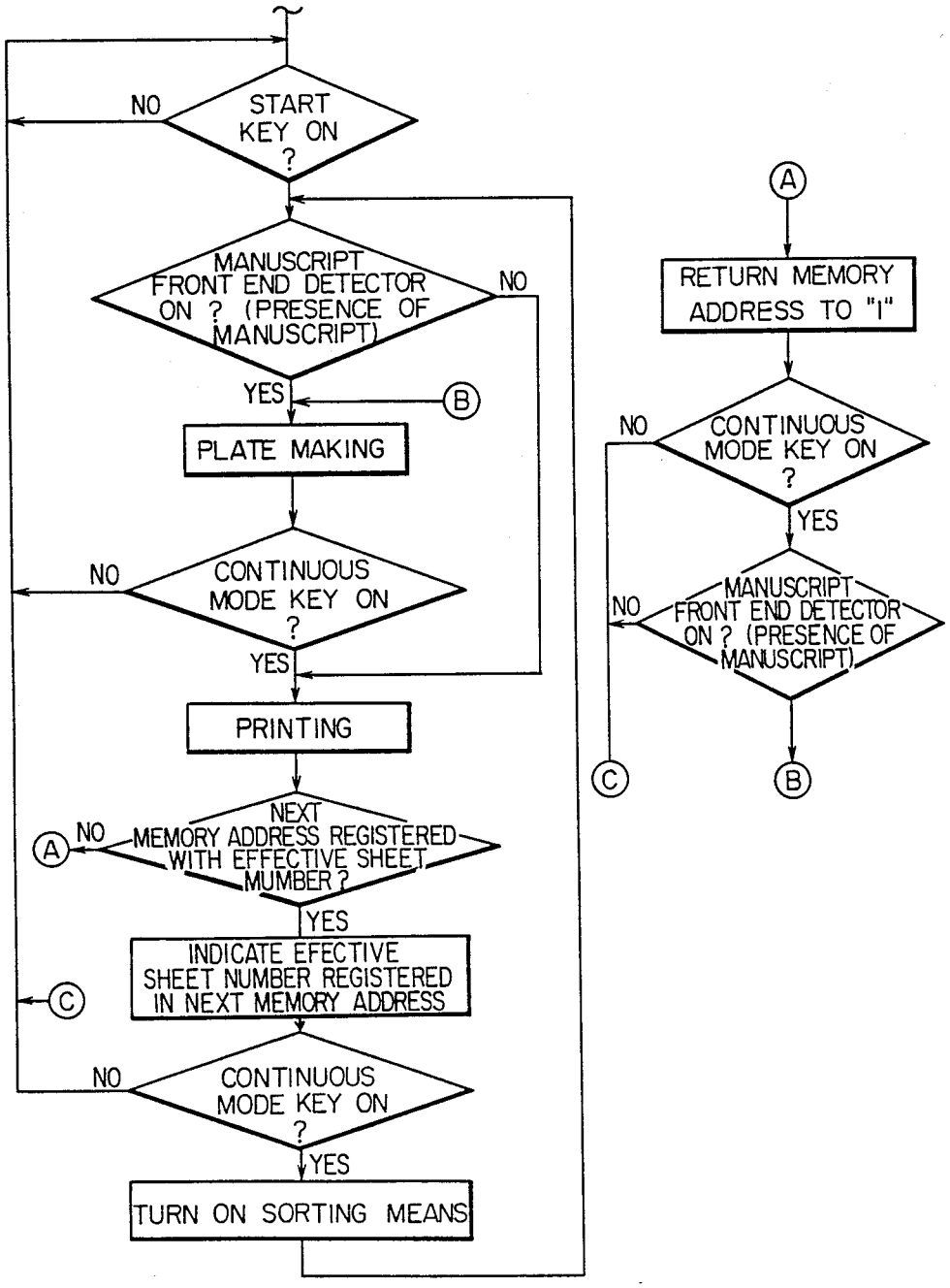
FIG. 4 is a flow chart illustrative of the operation of the FIG. 1 press.

The control circuit 10 controls the operation of the press, modes of which are exemplified as will be described later, under the direction of a CPU in accordance with a flow chart as shown in FIG. 4.

Figure 2:
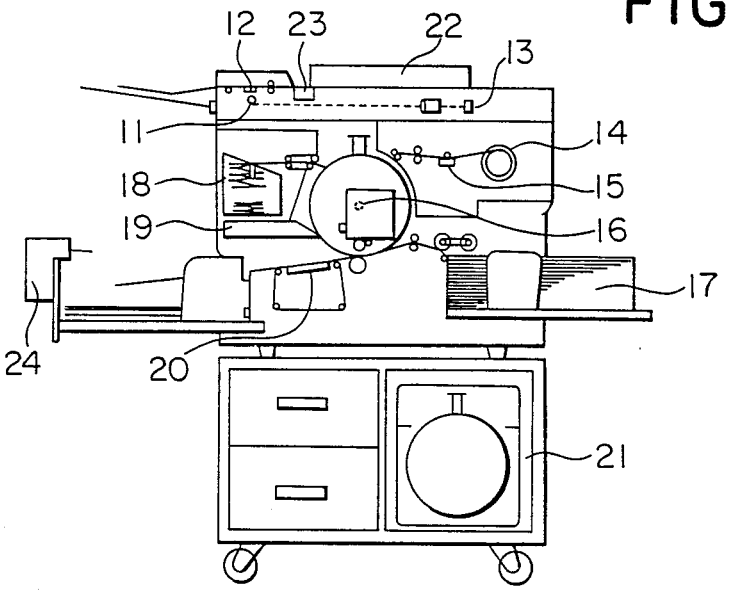
FIG. 2 is a front view illustrating an example of a press arrangement shown in FIG. 1.

The press arrangement 1 is exemplified in FIG. 2, including a mirror 11, a contact glass member 12, a CCD 13, a roll master 14, a thermal head 15, an inking device 16, a stack of printing paper sheets 17, a plate discharge box 18, a paper discharge blower 19, a paper discharge vacuum device 20, a table 21 for exclusive use, a manuscript setter 22, a manuscript front end detector 23, and a discharged paper sorter 24.

Figure 3:
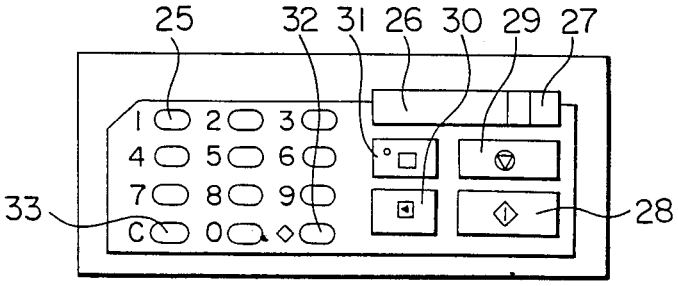
FIG. 3 is a front view illustrating an operation panel of a control arrangement shown in FIG. 1.

The control arrangement 2 has an operation panel as shown in FIG. 3 which includes ten keys 25, a counter 26, a memory address indicator 27, a start key 28, a stop key 29, a plus one key 30, a continuous mode key 31, a memory key 32, and a clear key 33.

The ten keys 25 and clear key 33 constitute the printing sheet number inputting means 6, and the continuous mode key 31 serves as the continuous mode commanding means 8. In order to confirm a plurality of printing sheet numbers stored in the memory 9, the memory key 32 is depressed so that a subsequent memory address and a printing sheet number stored in this address can be indicated on the memory address indicator 27 and counter 26, respectively. The memory key 32 is also used together with the ten keys 25 in such a manner that it is turned on each time one of a plurality of sets of sheet number is inputted following inputting of a first set.

The operation of the plate making and printing press will now be described by way of several examples of operational mode.

EXAMPLE 1

A general operational mode in which printing is carried out for a printing sheet number (for example, 100 sheets) by using a single manuscript.

(a) Operation by the user a-1—Set a manuscript in the manuscript setter 22.

a-2—Input a printing sheet number of 100 sheets by using the printing sheet number inputting means 6, i.e., ten keys 25.

a-3—Turn on the continuous mode key 31 serving as the continuous mode commanding means 8 to ensure that a plate making process can continuously shift to a printing process.

a-4—Turn on the start key 28.

(b) Operation by the press b-1—Execute a series of sequential operations "plate discharge", "plate making" and "plate feed".

b-2≦Start printing. When 100 sheets of paper have been printed, stop printing.

b-3—Recognize that a memory address "2" (as indicated) is registered with "0" and no subsequent manuscript is set, and cause the memory address indicator to indicate "1" and stop the press.

The conventional general operational mode completes through the above procedures.

EXAMPLE 2

An operational mode in which paper sheets printed in accordance with a single manuscript are sorted into a plurality of classes of different sets of sheet number (typically carried out in school activities).

As an example, paper sheets printed in accordance with a manuscript are sorted into a first set of 30 sheets, a second set of 35 sheets, a third set of 32 sheets and a fourth set of 38 sheets.

(a) Operation by the user a-1—Set a manuscript in the manuscript setter 22.

a-2—Input four sets of sheet number sequentially for storage.

a-2—Input 30 sheets to a memory address "1" (as indicated) by operating ten keys 25.

a-2—Turn on the memory key 32 and input 35 sheets to a memory address "2" by operating the ten keys 25.

a-2-3—Turn on the memory key 32 and input 32 sheets to a memory address "3" by operating the ten keys 25.

a-2-4—Input 35 sheets to a memory address "4" by operating ten keys 25 in the same manner as in the case of a-2-3.

a-2-5—Since no memory address following the memory address "4" is used, leave a memory address "5" unregistered (registered with zero sheet) and turn on the memory key 32 again to return memory address indication to "1".

a-3—Turn on the continuous mode key 31.

a-4—Turn on the start key 28.

(b) Operation by the press b-1—Execute plate making.

b-2—Print 30 sheets corresponding to the memory address "1".

b-3—Turn on the sorting means (in this example, a tape marker serves as the sorting means).

b-4—Print 35 sheets corresponding to the memory address "2".

b-5—Turn on the tape marker.

b-6—Print 32 sheets corresponding to the memory address "3".

b-7—Turn on the tape marker.

b-8—Print 38 sheets corresponding to the memory address "4".

b-9—Recognize that the memory address "5" is registered with "0" and no subsequent manuscript is set, cause the continuous mode key to be rendered off, return the memory address indication to "1" and stop the press.

EXAMPLE 3

An operational mode in which printing based on each of a plurality of manuscripts is effected for the same sheet number.

As an example, two manuscripts are employed and 20 sheets of paper are printed using each of the two manuscripts.

(a) Operation by the user a-1—Set two manuscripts in the manuscript setter 22 (equipped with an ADF).

a-2—Input 20 sheets to the memory address 37 1" by operating the ten keys 25.

a-3—Turn on the continuous mode key 31.

a-4—Turn on the start key 28.

(b) Operation by the press b-1—Execute plate making based on a first manuscript.

b-2—Print 20 sheets in accordance with a first plate.

b-3—Turn on the sorting means (tape marker).

b-4—Execute plate making based on a second manuscript as set.

b-5—Print 20 sheets in accordance with a second plate.

b-6—Recognize that the memory address "2" is registered with "0" and no subsequent manuscript is set, keep the memory address indication "1", cause the continuous mode key to be rendered off and stop the press.

EXAMPLE 4

An operational mode in which printing based on each of a plurality of manuscripts is effected for diferent sheet numbers.

As an example, two manuscripts are employed, and 25 sheets of paper are printed using a first manuscript and 15 sheets using a second manuscript.

(a) Operation by the user a-1—Set two manuscripts in the manuscripts setter 22 (equipped with the ADF).

a-2—Input 25 sheets to the memory address "1" by operating the ten keys 25.

a-3—Turn on the memory key 32 to indicate the memory address "2" and input 15 sheets to the memory address "1".

a-4—Turn on the memory key 32 to return the memory address indication to "1".

a-5—Turn on the continuous mode key 31.

a-6—Turn on the start key 28.

(b) Operation by the press b-1—Execute plate making based on a first manuscript.

b-2—Print 25 sheets in accordance with a first plate.

b-3—Turn on the sorting means (tape marker).

b-4—Indicate the memory address "2".

b-5—Execute plate making based on a second manuscript.

b-6—Print 15 sheets in accordance with a second plate.

b-7—Recognized that the memory address "3" is registered with "0" and no subsequent manuscript is set, return the memory address indication to "1" and cause the continuous mode key to be rendered off.

In the above procedures, the capacity of storage for the plurality of sheet numbers is precedently determined in the course of preparation of a program and it is herein assumed that n+1 kinds of memory addresses are provided. By turning on the memory key 32, the memory addresses are sequentially indicated, beginning with the memory address "1". When a memory address is unregistered, that is, registered with "0", the subsequent memory address indication is automatically returned to "1".

The memory addresses are used as exemplarily illustrated in FIGS. 5A and 5B. In an example of FIG. 5A, memory addreses "1" to "n" are used and these memory addresses are sequentially indicated, beginning with "1" and being +1 incremented sequentially, along with indication of preset printing sheet numbers corresponding to the memory addresses. Since a memory address "n+1" is registered with "0", the memory address "n" is followed by automatic return to the memory address "1". In an example of FIG. 5B, only one printing sheet number is inputted and 50 sheets corresponding to the memory address "1" are indicated repetitiously.

Although in Example 3 and 4 described previously the manuscript setter 22 is equipped with the ADF, this ADF may be omitted. In this case, printing sheet numbers are initially stored in corresponding memory addresses and after completion of storage of the printing sheet numbers, the initial printing sheet number is indicated and a first manuscript is set in the manuscript setter 22 (included in the manuscript presence/absence detecting means 7). Then the continuous mode key 31 is turned on and the start key 28 is also turned on so as to execute plate making and printing in succession based on the first manuscript, as in the case of Example 1. Subsequently, during printing based on the thus prepared first plate, a subsequent manuscript is set in the manuscript setter 22. Then, because the subsequent manuscript is detected and the continuous mode key is rendered on when the printing is finished as is clear from the flow chart of FIG. 4, plate making based on the subsequent manuscript is automatically started at that time and thereafter shifts to a printing process. It will therefore be appreciated that in the case of provision of the ADF, a plurality of manuscripts are all set initially and thereafter all the procedures are left up to the press and that even without resort to the ADF, the same sorting operation as that in Examples 3 and 4 can be achieved by setting the subsequent manuscript during execution of printing based on the preceding plate.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A plate making and printing press having integration of a plate making unit and a printing unit fed with a master prepared by said plate making unit to effect printing based on the master, said press comprising a memory for storing printing sheet numbers for each of a plurality of manuscripts;

means for inputting the printing sheet numbers to said memory, continuous mode commanding means for automatically driving said plate making unit immediately after the termination of a preceding printing process based on a preceding master so that a subsequent plate making process is initiated to prepare a subsequent master and feeding the subsequent master to said printing unit to permit the subsequent plate making process to continuously shifting to a subsequent printing process; and control means for fetching, prior to the continuous shifting to the subsequent printing process, data indicative of a printing sheet number for said subsequent printing process from said memory and permitting said subsequent printing process to be carried out in accordance with the data.

2. A plate making and printing press according to claim 1 further comprising detecting means for detecting that a subsequent manuscript is set in said plate making unit after the termination of the preceding printing process and producing a detection signal, said plate making unit being permitted to be driven automatically only when the detection signal is produced from said detecting means.

3. A plate making and printing press according to claim 1 wherein said memory has a plurality of memory addresses and a printing sheet number is set in each of the memory addresses by operating a memory key and ten keys provided on an operation panel.

4. A plate making and printing press according to claim 3 further comprising control means for invalidating the continuous mode when a memory address is registered with a printing sheet number of zero.

5. A plate making and printing press according to claim 1 wherein said plate making unit is equipped with an ADF, whereby with the continuous mode being set, said ADF is automatically actuated at the termination of a printing process to set a manuscript in said plate making unit and permit a plate making process to be initiated.

* * * * *